US008739884B2

(12) United States Patent
Lake

(10) Patent No.: US 8,739,884 B2
(45) Date of Patent: Jun. 3, 2014

(54) STACKABLE MULTI-BARRIER SYSTEM AND METHOD

(75) Inventor: Gary B. Lake, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 371 days.

(21) Appl. No.: 12/961,965

(22) Filed: Dec. 7, 2010

(65) Prior Publication Data

US 2012/0138310 A1 Jun. 7, 2012

(51) Int. Cl.
*E21B 23/00* (2006.01)
*E21B 34/00* (2006.01)

(52) U.S. Cl.
USPC ..... 166/373; 166/66.6; 166/386

(58) Field of Classification Search
USPC ..... 166/373, 66.6, 386
See application file for complete search history.

(56) References Cited

U.S. PATENT DOCUMENTS

| | | | |
|---|---|---|---|
| 5,372,193 | A | 12/1994 | French |
| 5,465,787 | A | 11/1995 | Roth |
| 5,831,156 | A | 11/1998 | Mullins |
| 5,875,852 | A | 3/1999 | Floyd et al. |
| 6,302,216 | B1 | 10/2001 | Patel |
| 6,491,102 | B2 | 12/2002 | Leismer et al. |
| 6,598,675 | B2 | 7/2003 | Bussear et al. |
| 6,675,893 | B2 | 1/2004 | Lund |
| 6,695,049 | B2 | 2/2004 | Ostocke et al. |
| 7,152,688 | B2 | 12/2006 | Richards |
| 7,219,743 | B2 | 5/2007 | Wolters et al. |
| 7,228,914 | B2 | 6/2007 | Chavers et al. |
| 7,322,422 | B2 | 1/2008 | Patel |
| 7,428,924 | B2 | 9/2008 | Patel |
| 7,430,153 | B2 | 9/2008 | Fraser et al. |
| 7,487,830 | B2 | 2/2009 | Wolters et al. |
| 7,617,876 | B2 | 11/2009 | Patel et al. |
| 7,640,977 | B2 | 1/2010 | Jonas |
| 8,056,628 | B2 | 11/2011 | Whitsitt et al. |
| 8,286,713 | B2 | 10/2012 | Broussard |
| 2003/0150622 | A1 | 8/2003 | Patel et al. |
| 2003/0211768 | A1 | 11/2003 | Cameron et al. |
| 2004/0159444 | A1 | 8/2004 | Wolters et al. |
| 2005/0092501 | A1 | 5/2005 | Chavers et al. |
| 2005/0126789 | A1 | 6/2005 | Nivens et al. |
| 2006/0151183 | A1 | 7/2006 | Turner |
| 2007/0084607 | A1 | 4/2007 | Wright et al. |
| 2007/0227727 | A1 | 10/2007 | Patel et al. |

(Continued)

FOREIGN PATENT DOCUMENTS

WO 2011005826 A1 1/2011

OTHER PUBLICATIONS

Martin P. Coronado et al., "Advanced Openhole Completions Utilizing a Simplified Zone Isolation System"; Socity of Petroleum Engineers, SPE Paper No. 77438; Sep. 29, 2002.

(Continued)

*Primary Examiner* — Giovanna Wright
(74) *Attorney, Agent, or Firm* — Cantor Colburn LLP

(57) ABSTRACT

A multi-barrier system includes a first valve in fluid communication with a lower completion that is electrically actuatable and inductively coupled to an upper completion. Also included is a second valve in fluid communication with the lower completion, both the first valve and the second valve, positioned proximate an uphole extent of the lower completion, are closable in response to retrieving the upper completion and openable subsequent reengagement of an upper completion.

12 Claims, 3 Drawing Sheets

(56) References Cited

U.S. PATENT DOCUMENTS

| | | | | |
|---|---|---|---|---|
| 2007/0235185 | A1 | 10/2007 | Patel et al. | |
| 2007/0295504 | A1* | 12/2007 | Patel | 166/263 |
| 2008/0223585 | A1 | 9/2008 | Patel et al. | |
| 2009/0025923 | A1* | 1/2009 | Patel et al. | 166/51 |
| 2009/0078429 | A1 | 3/2009 | Du et al. | |
| 2010/0300702 | A1 | 12/2010 | Andrews et al. | |
| 2011/0192596 | A1* | 8/2011 | Patel | 166/250.11 |
| 2012/0138309 | A1 | 6/2012 | Lake | |

OTHER PUBLICATIONS

L. Izquierdo et all, "Managing the Retrieval of Triple-Zone Intelligent Completions in Extended-Reach Wells Offshore California"; Society of Petroleum Engineers, SPE Paper No. 112115; Mar. 4, 2008.

Dwayne Leismer, "A System Approach to Annular Control for Total Well Safety"; Offshore Technology Conference; Paper No. OTC 7349; May 3, 1993.

K. Munday et al., "Want to Make Tree Operations Safer? Why Not Use the DHSV as a Barrier?"; Society of Petroleum Engineers, SPE Paper No. 96337; Sep. 24, 2006.

T.A. Nassereddin et al., "Electromagnetic Surface-Controlled Sub-Surface Safety Valve: An Immediate Soluation to Secure Wells with Damaged Control Line"; Society of Petroleum Engineers, SPE Paper No. 138356; Nov. 1, 2010.

Notification of Transmittal of the International Search Report and the Written Opinion of the International Searching Authority; PCT/US2011/060168; Mailed Jun. 29, 2012; Korean Intellectual Property Office; 10 pages.

Great Britain Search Report for GB Application No. 1303095.2, dated Jun. 24, 2013, pp. 1-5.

* cited by examiner

STACKABLE MULTI-BARRIER SYSTEM AND METHOD

BACKGROUND

In the downhole drilling and completion industry, there is often need to contain fluid within a formation during various operations. Conventionally, a mechanical barrier is put in the system that can be closed to contain the formation fluid when necessary. One example of a system known in the art will use a valve in operable communication with an Electric Submersible Pump (ESP) so that if/when the ESP is pulled from the downhole environment, formation fluids will be contained by the valve. While such systems are successfully used and have been for decades, in an age of increasing oversight and fail safe/failure tolerant requirements, additional systems will be well received by the art.

BRIEF DESCRIPTION

Disclosed herein is a multi-barrier system. The system includes a first valve in fluid communication with a lower completion that is electrically actuatable and inductively coupled to an upper completion. Also included is a second valve in fluid communication with the lower completion, both the first valve and the second valve are positioned proximate an uphole extent of the lower completion, and both the first valve and the second valve are closable in response to retrieving the upper completion and openable subsequent reengagement of an upper completion.

Also disclosed is a method of closing multiple barriers upon retrieval of an upper completion and opening of the multiple barriers subsequent reengagement of an upper completion with a lower completion. The method includes inductively coupling an electric line of the upper completion with an electric line of the lower completion in functional communication with a first valve of the lower completion, retrieving the upper completion from the lower completion, electrically closing the first valve upon functional decoupling of the inductive coupling, mechanically closing a second valve upon disengagement of the upper completion from the lower completion, reengagement of an upper completion with the lower completion, inductively coupling an electric line of the reengaged upper completion with the electric line of the lower completion, and electrically opening the first valve with electrical signals or power transmitted through the inductive coupling.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
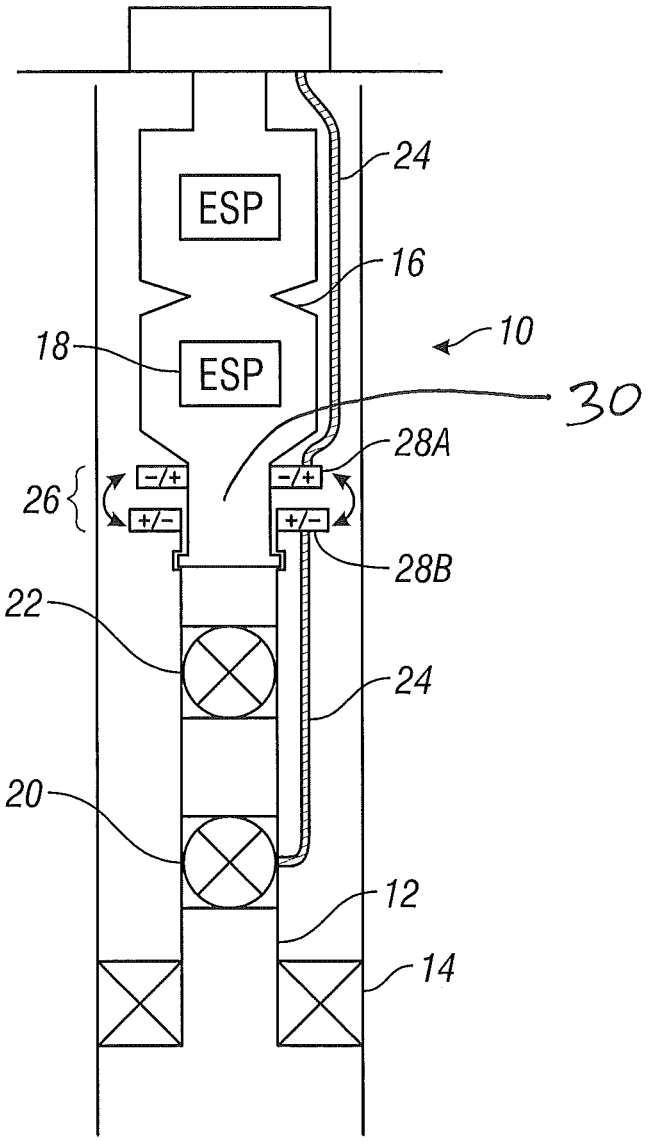
FIG. 1 is a schematic view of a multi-barrier system disclosed herein.

Referring to FIG. 1, a multi-barrier system 10 is illustrated. Illustrated is a portion of a lower completion 12, a packer 14 and a portion of an upper completion 16. One of ordinary skill in the art will be familiar with the lower completion 12 and the packer 14 and the concept of an upper completion 16 in operable communication therewith. In the illustrated embodiment an electric submersible pump (ESP) 18 is included in the upper completion 16, which is a device well known to the art. Between the illustrated ESP 18 and the lower completion 12 however, one of ordinary skill in the art will be surprised to see a number of mechanical barriers 20, 22 (sometimes referred to herein as "valves") that is greater than one. As illustrated in the figures hereof there are two but nothing in this disclosure should be construed as limiting the number of mechanical barriers to two. Rather more could also be added, if desired.

In one embodiment the more downhole valve 20 is an electrically actuated valve such as an ORBIT™ valve available commercially from Baker Hughes Incorporated, Houston Tex. and the more uphole valve 22 is a mechanically actuated valve such as a HALO™ valve available from the same source. It will be appreciated that these particular valves are merely exemplary and may be substituted for by other valves without departing from the invention.

Electrical lines 24 are provided to the valve 20 for electronic operation thereof. The electrical lines 24 run along both the upper completion 16 and the lower completion 12. In the illustrated embodiment an inductive coupler 26 transports electrical communication that may include one or both of electrical signals and electrical power between a first portion 28A and a second portion 28B that are in operable communication with the electrical lines 24 along the upper completion 16 and the electrical lines 24 along the lower completion 12 respectively. The inductive coupler 26 allows for retrieval of the upper completion 16 apart from the lower completion 12. Also included in this embodiment of the system 10 is a stroker 30 that may be a hydraulic stroker in some iterations.

The components described function together to manage flow between the lower completion 12 and the upper completion 16. This is accomplished in that the valve 20 is settable to an open or closed position (and may be variable in some iterations) based upon electrical communication in the electrical lines 24. The valve 22 is opened or closed based upon mechanical input generated by movement of the upper completion 16, or in the case of the illustration in FIG. 1, based upon mechanical movement caused by the stroker 30 that is powered by hydraulic fluid pressure. Of course, the stroker 30 could be electrically driven or otherwise in other embodiments. In any condition, the valve 22 is configured to close upon withdrawal of the upper completion 16. In normal production, both of the valves 20 and 22 will remain open unless there is a reason to close them. Such a reason occurs, for example, when it is required to retrieve the upper completion 16 for some reason. One such reason is to replace the ESP 18. Regardless of the reason for closure, employment of the system 10 in a completion string provides more than one mechanical barrier 20, 22 at an uphole extent of the lower completion 12. The barriers when closed prevent fluid flow after the upper completion is retrieved.

Figure 2:
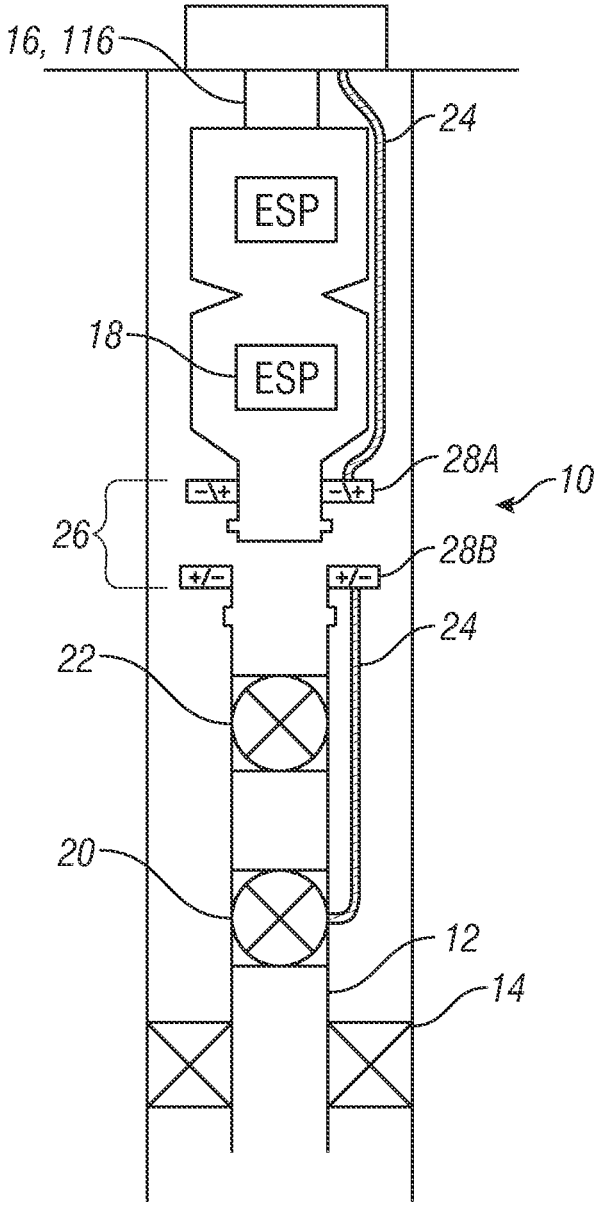
FIG. 2 is a schematic view of the system of FIG. 1 in partial withdrawal from the borehole.

Attention is directed to the inductive coupler 26 and FIG. 2. During withdrawal of the upper completion 16, the electrical lines 24 along the upper completion 16 are uncoupled from the electrical lines 24 along the lower completion 12 as the portion 28A is separated from the portion 28B. The valve 20, if not already closed, is configured to close in response to this uncoupling of the electrical lines 24. This will complete the separation of the upper completion 16 from the lower completion 12 and allow retrieval of the upper completion 16 to the surface. With more than one mechanical barrier 20, 22 in place at the uphole extent of the lower completion 12, there is improved confidence that fluids will not escape from the lower completion 12.

In order to restore production, the same upper completion 16 or another similar upper completion 116 is run in the hole. Whether the same or a new upper completion 16, 116 is being run items similar to the ESP 18, the electrical line 24 and the portion 28A of the inductive coupler 26 are incorporated thereon. The newly installed upper completion 16, 116 can be fully engaged with the lower completion 12 to provide the full functionality of the original system 10, including the ability to open and close each of the valves 20, 22 as desired. Moreover, it should be understood that the process of pulling out and stabbing in with the same or new upper completions 16, 116 can go on ad infinitum (or at least until practicality dictates otherwise).

Figure 3:
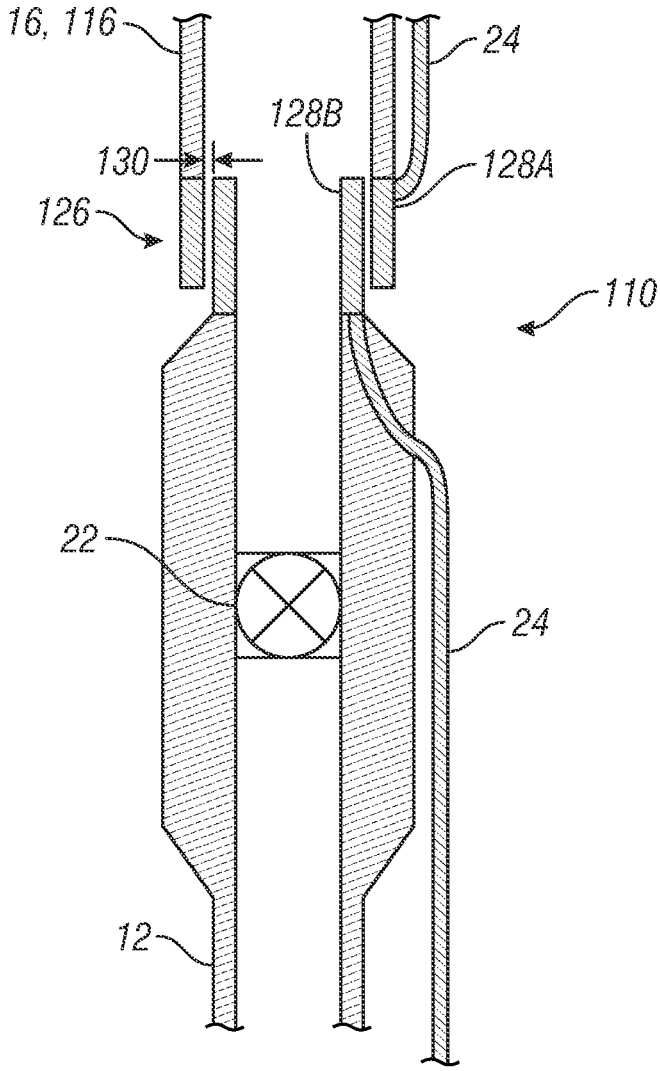
FIG. 3 is a schematic view of a portion of an alternate multi-barrier system disclosed herein illustrating an alternate inductive coupler configuration.

Referring to FIG. 3, a multi-barrier system 110 having an inductive coupler 126 with portions 128A and 128B in electrical communication with the electrical lines 24 is illustrated. The inductive coupler 126 differs from the inductive coupler 26 in that the portions 128A and 128B are displaced from one another radially instead of axially. As such a gap dimension 130 between the two portions 128A, 128B is determined by relative dimensions of the portions 128A, 128B and is not altered by foreign material, such as contamination, positioned therebetween. Additionally, the inductive coupler 126 can tolerate a greater range of axial positions between the portions 128A, 128B than the inductive coupler 26 while still maintaining full operational functioning thereacross.

The foregoing apparatus and method for its use allows for the retrieval and replacement of an upper completion without the need for a wet connection.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A multi-barrier system comprising:

a first valve in fluid communication with a lower completion being electrically actuatable and inductively coupled to an upper completion; and a second valve in fluid communication with the lower completion, both the first valve and the second valve being positioned proximate an uphole extent of the lower completion, and both the first valve and the second valve being closable in response to retrieving the upper completion and openable subsequent reengagement of an upper completion, and both the first valve and the second valve being configured to prevent flow through an opening in the lower completion created by retrieval of the upper completion when the first valve and the second valve are closed.

2. The multi-barrier system of claim 1, further comprising an inductive coupler capable of transporting at least one of electrical signals and electrical power thereacross.

3. The multi-barrier system of claim 2, wherein a first portion of the inductive coupler is disposed at the upper completion and a second portion of the inductive coupler is disposed at the lower completion.

4. The multi-barrier system of claim 3, wherein the first portion is longitudinally displaced from the second portion when configured to transport at least one of electrical signals and electrical power thereacross.

5. The multi-barrier system of claim 3, wherein the first portion is radially displaced from the second portion when configured to transport at least one of electrical signals and electrical power thereacross.

6. The multi-barrier system of claim 3, wherein the first valve is configured to close when the first portion is functionally disengaged from the second portion.

7. The multi-barrier system of claim 2, wherein the first valve is openable via at least one of electrical signals and electrical power transported through the inductive coupler.

8. The multi-barrier system of claim 1, wherein the second valve is mechanically closed upon withdrawal of the upper completion.

9. The multi-barrier system of claim 1, wherein the second valve is reopenable subsequent reengagement of an upper completion with the lower completion.

10. The multi-barrier system of claim 1, wherein openability of neither the first valve nor the second valve requires a wet connection.

11. A method of closing multiple barriers upon retrieval of an upper completion and opening of the multiple barriers subsequent reengagement of an upper completion with a lower completion, comprising:

inductively coupling an electric line of the upper completion with an electric line of the lower completion being in functional communication with a first valve of the lower completion;

retrieving the upper completion from the lower completion;

creating an opening in the lower completion with the retrieving of the upper completion;

electrically closing the first valve in response to functional decoupling of the inductive coupling;

preventing flow from the opening in the lower completion with the closing of the first valve;

mechanically closing a second valve in response to disengagement of the upper completion from the lower completion;

preventing flow from the opening in the lower completion with the closing of the second valve;

reengaging an upper completion with the lower completion;

inductively coupling an electric line of the reengaged upper completion with the electric line of the lower completion; and electrically opening the first valve with electrical signals or power transmitted through the inductive coupling.

12. The method of closing multiple barriers upon retrieval of an upper completion and opening of the multiple barriers subsequent reengagement of an upper completion with a lower completion of claim 11, further comprising mechanically opening the second valve via the reengaging of the upper completion with the lower completion.

* * * * *